US007837568B1

(12) United States Patent
Glaze

(10) Patent No.: US 7,837,568 B1
(45) Date of Patent: Nov. 23, 2010

(54) METHOD AND APPARATUS FOR SUPPORTING A CHILD IN A SWING

(76) Inventor: Dale M. Glaze, 486 Hwy. 197 S., Mt. Airy, GA (US) 30563

( * ) Notice: Subject to any disclaimer, the term of this patent is extended or adjusted under 35 U.S.C. 154(b) by 802 days.

(21) Appl. No.: 11/448,407

(22) Filed: Jun. 7, 2006

Related U.S. Application Data

(60) Provisional application No. 60/692,083, filed on Jun. 20, 2005.

(51) Int. Cl.
*A63G 9/12* (2006.01)
*A63G 9/00* (2006.01)

(52) U.S. Cl. ..... 472/118

(58) Field of Classification Search ..... 472/118–125; 297/273–275, 281, 282, 440.11, 440.14, 297/440.1
See application file for complete search history.

(56) References Cited

U.S. PATENT DOCUMENTS 296,946 A * 4/1884 Gardner ..... 297/275
743,546 A * 11/1903 Nix ..... 297/276
1,503,493 A * 8/1924 Eiffe ..... 297/273
4,881,780 A 11/1989 Barnes
5,326,327 A * 7/1994 Stephens et al. ..... 472/118
5,533,934 A * 7/1996 Miller ..... 472/118
5,676,426 A * 10/1997 Herring ..... 297/484
5,733,014 A * 3/1998 Murray ..... 297/485
5,839,965 A 11/1998 Mullins
5,984,792 A * 11/1999 Clark ..... 472/118
6,244,611 B1 * 6/2001 Davis ..... 280/290
2003/0040372 A1 2/2003 McNutt et al.

* cited by examiner

*Primary Examiner*—Kien T Nguyen
(74) *Attorney, Agent, or Firm*—The Law Firm of Andrea Hence Evans, LLC

(57) ABSTRACT

A back support device utilizes a removable fabric support strap attached to chain attachment assemblies for connection to the support chains of a swing. The chain attachment assemblies are attached to chain elements of the support chains so that the support strap of the device is positioned in the underarm area of an adult. The support strap has a width sufficient for supporting the back and underarms of an adult comfortably. A removable sleeve, slidable over the chain attachment assemblies and support strap of the device provides a means to quickly and easily clean and restore the device.

14 Claims, 3 Drawing Sheets

METHOD AND APPARATUS FOR SUPPORTING A CHILD IN A SWING

This application claims the benefits of U.S. Provisional Application No. 60/692,083, filed Jun. 20, 2005.

FIELD OF THE INVENTION

The present invention relates to apparatus and methods for supporting infants or children while in a swing, and more particularly, a method of apparatus and methods for supporting an adult holding a child in a swing.

BACKGROUND OF THE INVENTION

Swings are a long-time favorite of adults and children alike for pleasure and relaxation. Use of swings by young children and, especially, infants presents problems since they are too young and immature to safely support themselves in a conventional swing. Special infant swing seats which provide supports enclosing the child or infant may be used, such as a child restrain system disclosed in US Patent Application Publication 2003/0040372.

In many cases, an adult prefers to remain holding an infant or a young child while themselves are seated on a swing. Prior devices are either unusable, overly complex or impractical for use by the adult. For example, the device of US Patent Application Publication 2003/0040372 requires both hands to fasten, making the device impractical when attending to an infant.

There exists a need for a support device and method to allow supporting an infant or child during swinging, which allows use and constant attention of the child by an adult.

OBJECTS AND SUMMARY OF THE INVENTION

Therefore, an object of the present invention is to provide a back support device which supports an adult sufficiently to hold a child during swinging evolutions.

Another object of the present invention is to provide a support device that can be quickly and easily attached to different swing types;

Another object of the present invention is to provide a support device that does not require use of the hands to support the adult when sitting on a swing;

Another object of the present invention is to provide a support device that is comfortable and does not overly restrict movement of the adult;

Another object of the present invention is to provide a support device that can be quickly and easily cleaned;

Another object of the present invention is to provide a support device that utilizes decorative elements in the device; and Still another object of the present invention is to provide a support device that is simple and low in cost.

Still another object of the present invention is to provide a support device adding stability of an adult by supporting the back and underarms of an adult in a swing without surrounding, encircling or otherwise restraining the adult by loops or harnesses.

The support device of the present invention is a strap made of a comfortable material such as fabric. The device utilizes a pair of releasable fasteners, attached to ends of the strap for attaching the strap to the support chains of a swing. The support device is attached so that the strap is at a height that supports the back and underarms of the user. The added support allows an adult to hold a child or infant with one hand, and still allows the other hand for self-support. The support device does not require encircling or full harnessing of the user. Although the device would normally be used by adults for added stability when holding an infant or child who is unable to safely use a swing by themselves, the device could also be used by children or adults for improved safety and stability when using the swing by themselves.

In the preferred embodiments, the support device comprises a width sufficient to support the user without undue pressure from the strap. The strap may made of a length of flexible or semi-rigid material with the releasable fasteners on each end. Or the strap portion may be made by stitching a length of fabric in a loop. The device may utilize a cushion such as an elastic sleeve to cover the strap for added comfort while providing a means to maintain the cleanliness of the device. The sleeve may also comprise ornamental features such as sewn decorations or patches.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the apparatus and method for supporting a child in a swing.

Figure 1:
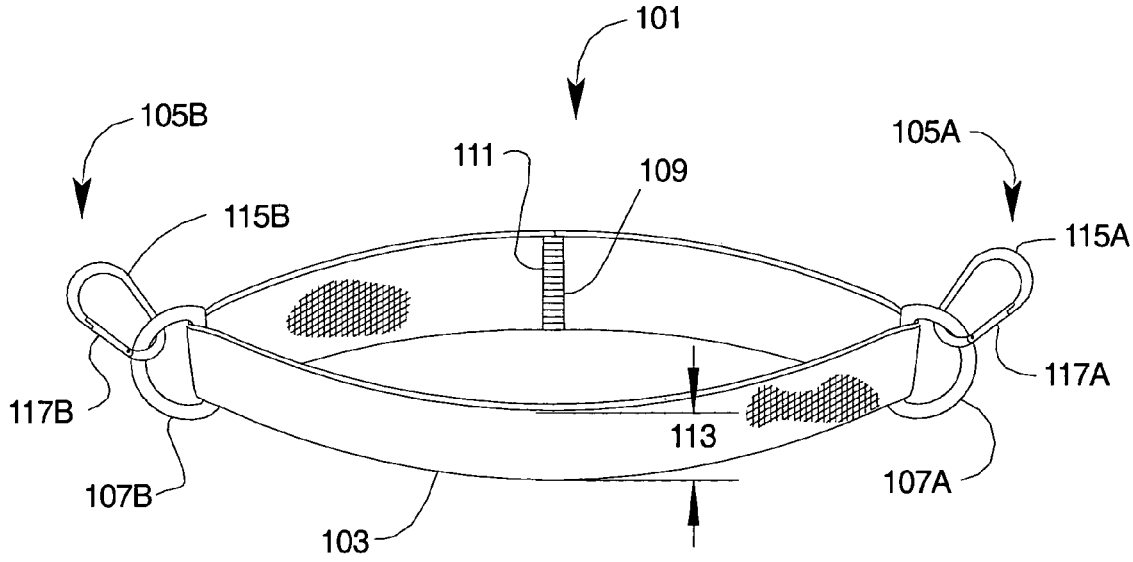
FIG. 1 is a top front perspective drawing of a preferred embodiment of the support apparatus or device having a support strap consisting of a fabric loop engaging two chain attachment assemblies.
Figure 2:
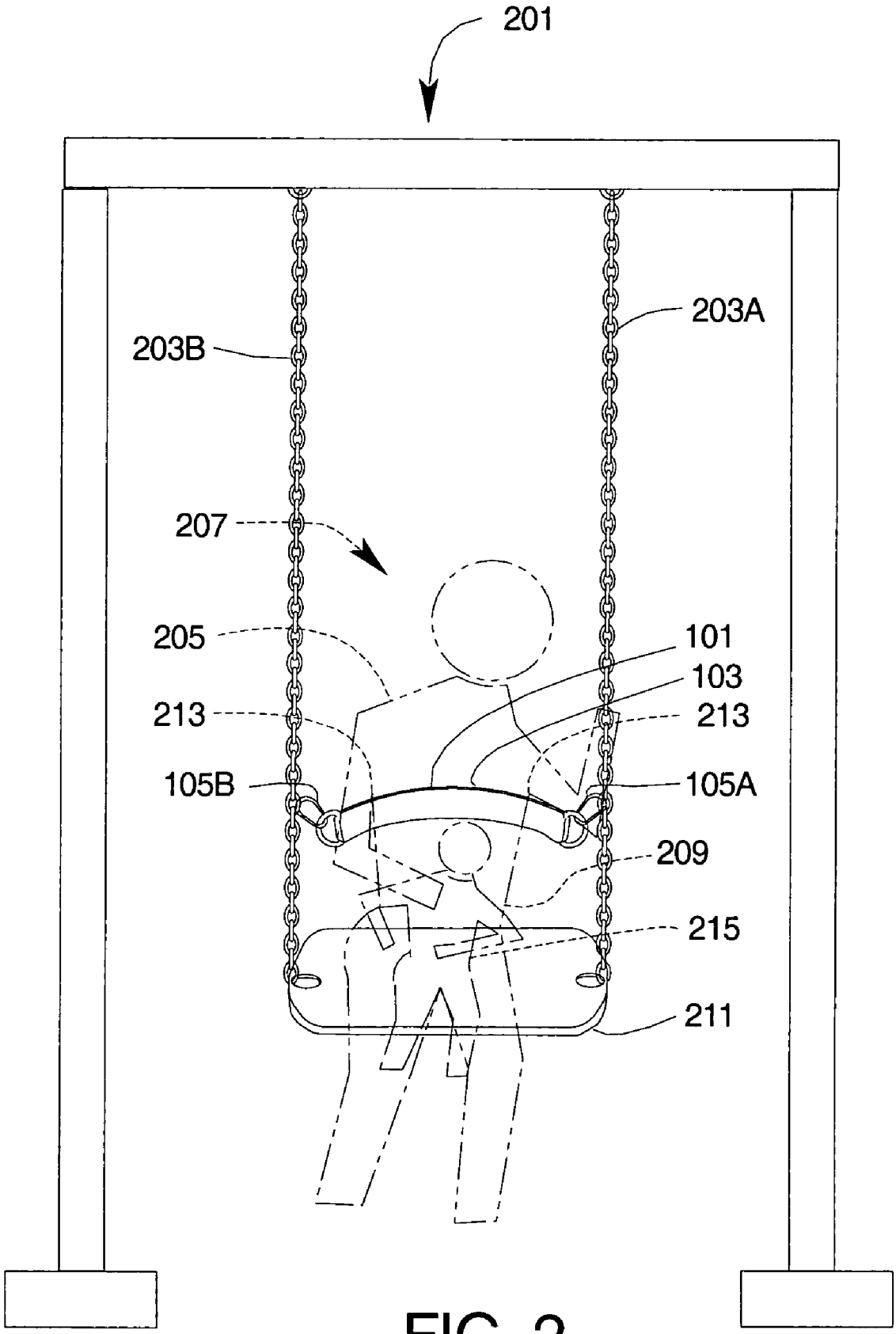
FIG. 2 is a front elevation drawing of the support device engaged to the support chains of a swing, and an adult supported by the support device by the back and underarms so that the adult is holding an infant with at least one hand, the adult and infant shown in phantom lines.

FIG. 1 is a perspective drawing of embodiment 101 of a back support device for supporting a child in a swing. The device comprises a support strap 103 and two chain fastening assemblies 105A, 105B. Fastening assemblies 105A, 105B comprise a means of attachment to the support strap and a second means to attach to a swing chain as shown in FIG. 2. In a preferred embodiment, support strap 103 is a fabric strap passing through D-rings 107A, 107B of chain fastening assemblies 105A, 105B and attached end-to-end at splice 109 to form a loop.

In the preferred embodiments, strap 103 is made of a high-strength woven material such as nylon or polyester fabric. In other embodiments, a soft fabric such as cotton fabric may be used. In still other embodiments, support strap 103 may be made of natural or synthetic belt materials such as leather, natural or synthetic rubber or other elastomers, or semi-rigid polymeric materials. In still other embodiments, strap 103 may be metal mesh or chain.

Splice 109 may be made by stitching, such as stitching 111, or it may be made by mechanical fasteners or by bonding. In the preferred embodiments, support strap 103 is of sufficient width 113 to provide distributed support and physical comfort to an adult supported by the strap when the strap is passed behind the back and under the armpits as shown in FIG. 2. In the preferred embodiments, support strap width 113 is at least 2 inches wide. In the more preferred embodiments, support strap width 113 is at least 3 inches wide. In the most preferred embodiments, support strap width 113 is at least 4 inches wide.

In the preferred embodiments, chain fastener assemblies 105A, 105B comprise a chain fastener such as spring clips 115A, 115B and D-rings 107A, 107B to provide a quick means to attach the support device to support chains 203A, 203B of FIG. 2. Spring clips 115A, 115B utilize pivoted spring-biased legs 117A, 117B to allow insertion of the clip and provides secure attachment as known in the art. In other embodiments, other chain attachment methods are used such as snap clips, S-clips, shackles, or other chain attachment fasteners known in the art. In still other embodiments, attachment assemblies 105A, 105B may be single piece fasteners, such as pelican hooks attached to support strap 103.

FIG. 2 is a front elevation drawing of fastening assemblies 105A, 105B of support device 101 attached to respective support chain assemblies 203A, 203B of swing 201. The fastening assemblies 105A, 105B are positioned on respective support chains 203A, 203B so that strap 103 of support device 101 is positioned at a height corresponding to a height between the shoulders 205 of an adult user 207 and the waist 209 of user 207 when seated on swing seat 211. In the more preferred embodiments, the fastening assemblies are positioned so that strap 103 of support device 101 is positioned at a height corresponding to a height of the armpits 213 of an adult user 207 when seated on swing seat 211.

With support device 101 installed on swing 201 in the manner shown, adult 207 is free to lean backward and be supported by support device 101. This additional support allows the adult to hold an infant or child 215 while using swing 201. The infant or child 215 may be held in the arm or arms of adult 207 while support device 101 provides securing support. Optionally, adult 207 may use one hand on a support chain 203A and one hand on child 215 as shown in the figure.

Figure 3:
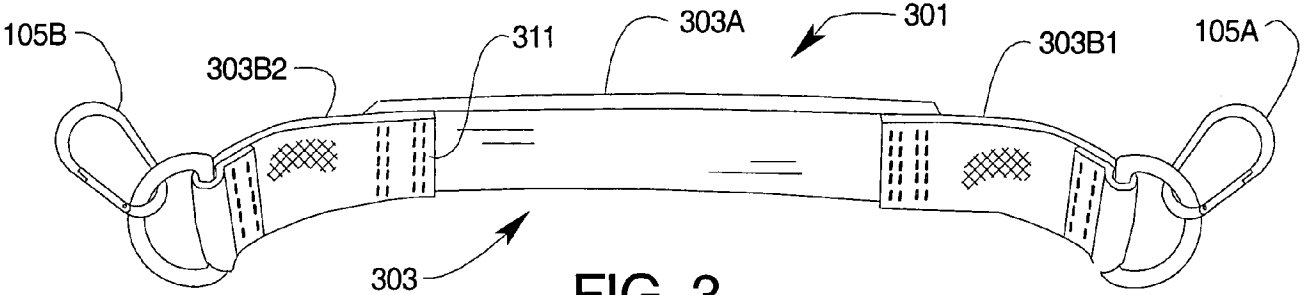
FIG. 3 is a top front perspective view of an embodiment of the support device utilizing a semi-rigid support strap portion.

FIG. 3 is a perspective view of support device 301 utilizing a semi-rigid belt portion 303A in support strap 303 for improved back support of a user of the device. Belt portion 303A may be made of leather, fabric, or a solid polymeric material such as polyethylene or polypropylene that provides good support and limited flexibility. In the preferred embodiment belt portion 303A is attached to flexible end strap portions 303B1, 303B2 by stitching 311, mechanical fasteners, or by bonding. End strap portions 303B1, 303B2 which fit under the armpits of the user may be made of woven fabric or other more flexible materials to provide comfort for the user. Chain fastening assemblies 105A, 105B provide chain attachment as described previously.

Figure 4:
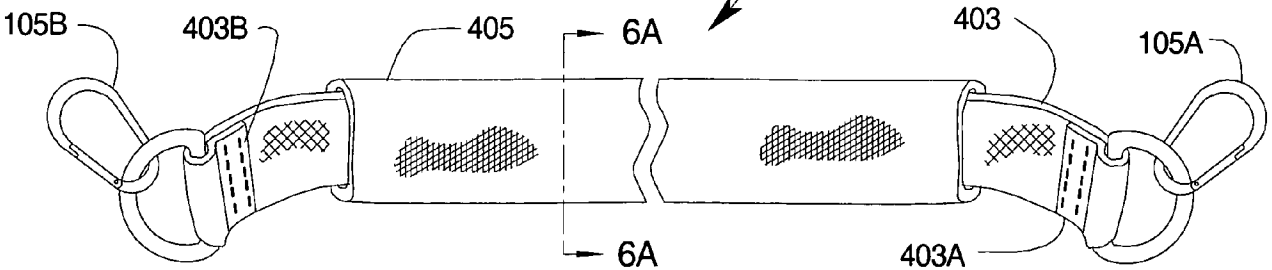
FIG. 4 is a top front perspective view of an embodiment of the support device having a removable sleeve.

FIG. 4 is a top front perspective view of embodiment 401 of the support device similar to embodiment 101 except support strap 403 is a single strap with ends 403A and 403B attached to chain fastening assemblies 105A, 105B. End attachments may be made by looping the respective ends around D-rings 107A, 107B and stitching or bonding, or other mechanical fasteners may be used. In the preferred embodiments, strap 403 is made of a fabric material as described in earlier embodiments. In still other embodiments, support strap 403 is a chain mesh or link chain and chain attachment assemblies 105A, 105B are single-piece hooks or snaps attaching the end loops of the chain to the support chains of FIG. 2

Removable sleeve 405 provides a means to improve comfort, add decorative effects, and simplify cleaning of the support device. In the preferred embodiments, sleeve 405 is made of an elastic fabric material, which can be expanded to slide over either end of the device. In the more preferred embodiments, sleeve 405 expands to slide over one of the chain fastening assemblies 105A, 105B into the position shown in FIG. 4. Sleeve 405 improves cushioning of the device as compared to support strap 403 alone, and allows easy removal and cleaning of sleeve 405. In still other embodiments, sleeve 405 is made of plastic, foamed plastic, or leather materials.

Figure 5:
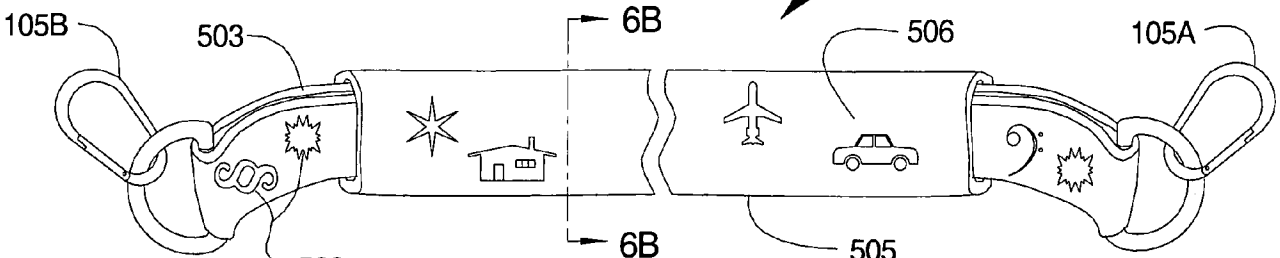
FIG. 5 is a top front perspective view of an embodiment of the support device utilizing a decorative removable sleeve.

FIG. 5 is a top front perspective view of embodiment 501 of the support device having decorative features. Support strap 503 is similar to that of support strap 103 of FIG. 1 having decorative designs 502 woven or printed onto strap 503. Removable sleeve 505 has decorative designs 506 woven or stitch into the material of the sleeve and otherwise similar to sleeve 405 of FIG. 5. In the preferred embodiments, the bottom and back views comprise the same ornamental features as the top front view.

Figure 6A:
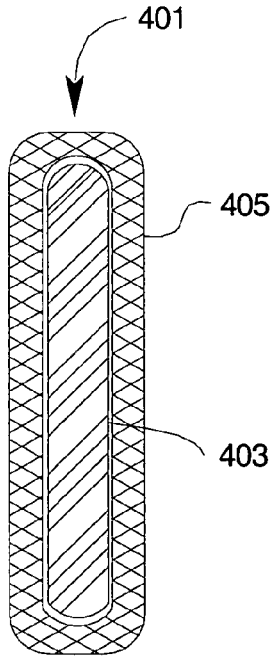
FIG. 6A is a cross section drawing of the support device of FIG. 4 taken through lines 6A-6A of FIG. 4.
Figure 6B:
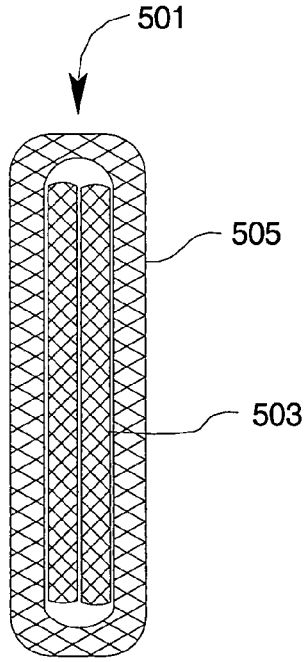
FIG. 6B is a cross section drawing of the support device of FIG. 5 taken through lines 6B-6B of FIG. 5.

FIG. 6A is a cross section of the support device 401 taken along lines 6A-6A of FIG. 4. Support strap 403 may be a fabric strap as shown in FIG. 4, or it may be a semi-rigid strap or strap portion as shown in FIG. 3. FIG. 6B is a cross section of the support device 501 taken along lines 6B-6B of FIG. 5. Support strap 503 may be a fabric loop strap as shown in FIG. 4 and FIG. 1, or it may be a single strap similar to that of FIG. 3 or FIG. 4.

Although the description above contains many specifications, these should not be construed as limiting the scope of the invention but merely providing illustrations of some of the presently preferred embodiments of this invention. Thus the scope of the invention should be determined by the appended claims and their legal equivalents, rather than by the examples given.

I claim:

1. A support system comprising:

a swing having a seat and chains; and a back support comprising a pair of chain fastener assemblies connected to a first ring and a second ring; and a support strap having a first end inserted into the first ring and out the second ring;

wherein the first end is connected to a second end of the support strap by attaching the ends directly together to define a loop, wherein the loop is closed such that a front portion of the support strap is flush with a second portion of the support strap;

wherein the support strap is attached to the chains at a height that provides support for a back and underarms of a user.

2. The support system of claim 1 wherein each of said fastener assemblies comprises a quick-connect fastener element for attaching said support strap to the chains of the swing.

3. The support system of claim 1 wherein each of said fastener assemblies comprises a loop and a quick-connect fastener element for attaching said support strap to the chains of the swing.

4. The support system of claim 3 wherein said loop is a D-ring and said quick-connect fastener comprises a spring-biased closure element.

5. The support system of claim 1 comprising a tubular fabric sleeve enclosing said support strap, said fabric sleeve comprising sufficient elasticity to be slid over an end of said support strap for assembly and removal for cleaning.

6. A support system comprising:

a swing having a seat and chains; and a back support comprising a support strap having a first end and a second end;

a first chain fastener assembly comprising a first chain fastening portion and a first strap attachment portion, said first strap attachment portion attached to said first end of said support strap; and a second chain fastener assembly comprising a second chain fastening portion and a second strap attachment portion, said second strap attachment portion attached to said second end of said support strap;

a sleeve inserted over the first strap attachment portion and onto the support strap providing additional support for a back and underarms of a user as the user's back contacts the sleeve;

wherein the first and second chain fastener assemblies secure the back support to the swing.

7. The support system of claim 6 wherein each of said chain fastener assemblies comprises a quick-connect fastener element for attaching said support strap to the chains of the swing.

8. The support system of claim 6 wherein each of said first strap attachment portion and second strap attachment portion comprises a loop element and each of said first chain fastening portion and said second chain fastening portion comprises a quick-connect fastener element for attaching said support strap to the chains of said swing.

9. The support system of claim 8 wherein said loop is a D-ring and said quick-connect fastener comprises a spring-biased closure element.

10. The support system of claim 6 wherein said support strap comprises a semi-rigid plastic material.

11. The support system of claim 6 wherein said support strap comprises a semi-rigid plastic material in a center portion of said support strap and a fabric material between said semi-rigid plastic material and each of said chain fastener assemblies.

12. The support system of claim 6 wherein said sleeve is made of a fabric material.

13. The support system of claim 12 wherein said sleeve comprises decorative features disposed on said sleeve.

14. A method of supporting a user on a swing having swing chains and a seat comprising:

providing a pair of chain fastener assemblies connected to a first ring and a second ring;

providing a support strap having a first end and a second end;

inserting the first end of the support strap through the first ring and out the second ring;

forming a loop with the support strap by attaching the first end of the strap directly to the second end of the strap;

securing the chain fastener assemblies to the swing chains;

positioning the support strap behind the user's back, wherein the loop is closed such that a front portion of the support strap becomes flush with a second portion of the support strap.

* * * * *